US007980454B2

(12) United States Patent
Burton et al.

(10) Patent No.: US 7,980,454 B2
(45) Date of Patent: Jul. 19, 2011

(54) COVERED CONTAINER FOR ENCLOSING MULTIPLE FOOD PRODUCTS

(75) Inventors: Jack Burton, Reno, TX (US); Karl Merkley, Paris, TX (US); Lynn English, Blossom, TX (US)

(73) Assignee: Paris Packaging, Inc., Paris, TX (US)

( * ) Notice: Subject to any disclaimer, the term of this patent is extended or adjusted under 35 U.S.C. 154(b) by 36 days.

(21) Appl. No.: 12/537,826

(22) Filed: Aug. 7, 2009

(65) Prior Publication Data

US 2010/0032474 A1 Feb. 11, 2010

Related U.S. Application Data

(60) Provisional application No. 61/087,286, filed on Aug. 8, 2008.

(51) Int. Cl.
*B65D 5/488* (2006.01)
*B65D 25/04* (2006.01)

(52) U.S. Cl. ..... 229/120.18; 229/114; 229/120.21; 229/904; 229/906

(58) Field of Classification Search ..... 229/120.18, 229/120.21, 904, 114, 146, 149, 150, 151
See application file for complete search history.

(56) References Cited

U.S. PATENT DOCUMENTS 2,747,732 A * 5/1956 Fischer ..... 229/150
2,924,372 A * 2/1960 Kirkeby ..... 206/563
2,951,583 A * 9/1960 Sanford ..... 229/149
3,161,342 A * 12/1964 Wenzel ..... 206/562
3,896,987 A * 7/1975 Soja ..... 229/151
3,899,119 A * 8/1975 Roccaforte ..... 206/562
4,431,128 A * 2/1984 Dirico ..... 229/904
4,694,987 A 9/1987 Forbes, Jr.
4,895,259 A * 1/1990 Paley ..... 206/565
5,431,333 A * 7/1995 Lorenz ..... 229/114
5,848,699 A * 12/1998 Pettersson ..... 229/114
5,890,648 A 4/1999 Cai
5,909,840 A * 6/1999 Schultheiss ..... 229/114
6,568,586 B1 * 5/2003 VanEsley et al. ..... 229/120.18
7,631,800 B2 * 12/2009 Cai et al. ..... 229/120.18
7,757,860 B2 * 7/2010 Philips ..... 206/562

* cited by examiner

*Primary Examiner* — Gary E Elkins
(74) *Attorney, Agent, or Firm* — Clements Bernard PLLC; Christopher L. Bernard

(57) ABSTRACT

The present invention provides a container configured to selectively enclose multiple food products, including: a tray including a first side wall, a second side wall, a front wall, a back wall, a bottom, and an internal wall disposed between the first side wall and the second side wall, wherein the first side wall, the second side wall, the front wall, the back wall, the bottom, and the internal wall disposed between the first side wall and the second side wall collectively define a first compartment configured to hold a first food product and a second compartment configured to hold a second food product; and a unified cover including a first side wall, a second side wall, a front wall, a back wall, and a top, wherein the first side wall, the second side wall, the front wall, the back wall, and the top are substantially coextensive with the tray.

14 Claims, 6 Drawing Sheets

COVERED CONTAINER FOR ENCLOSING MULTIPLE FOOD PRODUCTS

CROSS-REFERENCE TO RELATED APPLICATION(S)

The present non-provisional patent application/patent claims the benefit of priority of U.S. Provisional Patent Application No. 61/087,286, filed on Aug. 8, 2008, and entitled "COVERED CONTAINER FOR ENCLOSING MULTIPLE FOOD PRODUCTS," the contents of which are incorporated in full by reference herein.

FIELD OF THE INVENTION

The present invention relates generally to a covered container for enclosing multiple food products. More specifically, the present invention relates to a folded paperboard container or the like having a unified cover for simultaneously enclosing a primary food product and a secondary food product, sauce/condiment container, or the like.

BACKGROUND OF THE INVENTION

Folded paperboard containers and the like are often used in the fast food industry, among other industries. Advantageously, such containers are relatively simple and inexpensive to manufacture, ship, store, assemble, and use, and are typically disposable and environmentally friendly. Often, it is desirable for these containers to enclose multiple food products, such as a primary food product and a secondary food product, sauce/condiment container, or the like, separating the food products until the sauce/condiment or the like is added to the primary food product and the food products are consumed, for example. Typical examples of primary food products include chicken nuggets, hamburgers, french fries, etc. Typical examples of sauces/condiments include barbeque sauce, honey mustard, ketchup, etc. The sauce/condiment container may be substantially separable from the folded paperboard container or the like and made of a covered or uncovered plastic material, for example. Alternatively, the sauce/condiment container may be substantially inseparable from or integrally formed with the folded paperboard container or the like.

One such container is provided in U.S. Pat. No. 4,694,987, issued to Forbes, Jr., on Sep. 22, 1987. In general, Forbes, Jr., discloses a carryout carton for food products that includes a single tray element with a pair of integral lid members. A first locking means is provided for securing one lid member to the bottom wall of the tray and a second locking means is provided for securing the second lid to the first lid. The first locking means includes a first locking tab formed by a flap element attached to an extension of the front wall of the first lid and a first locking slot formed in the bottom wall of the tray. The second locking means includes a second locking tab formed by an extension of the front wall of the second lid and a second locking slot formed in the front wall of the first lid member.

Another such container is provided in U.S. Pat. No. 4,895,259, issued to Paley on Jan. 23, 1990. In general, Paley discloses a collapsible, self-locking carton, formed from a unitary blank of foldable paperboard, that is divided into two separate types of compartments for holding two different types of food items, one compartment having a horizontal wall with a central opening for holding a cylindrical item such as sauce cup, and the other component being a well with higher walls for holding taller elongated objects such as pretzels.

A further such container is provided in U.S. Pat. No. 5,890,648, issued to Cai on Apr. 6, 1999. In general, Cai discloses that the tray of a carton is divided into larger and smaller compartments by a transverse intermediate wall. The tray outer end wall at the smaller compartment is integrally formed with a lid panel folded to overlie the smaller compartment and extend laterally outward of opposed side walls of the tray. The intermediate wall is integral with and depends from the lid panel. A cover, with depending side walls, is integrally hinged to the second end wall of the tray with the cover side walls including forwardly extending lugs engagable with and beneath the transversely extending portions of the lid panel to releasably lock the cover in a closed position.

Each of these containers, however, and others in the art suffer from significant shortcomings. Some do not incorporate a cover, some incorporate a cover that encloses only one food product, and most are overly complex and expensive. This is problematic, as folded paperboard containers and the like are single-use items that are typically used by the thousands. Thus, incremental increases in material, handling, and use efficiency may lead to significant savings and/or market penetration.

BRIEF SUMMARY OF THE INVENTION

As described above, the present invention relates generally to a covered container for enclosing multiple food products. More specifically, the present invention relates to a folded paperboard container or the like having a unified cover for simultaneously enclosing a primary food product and a secondary food product, sauce/condiment container, or the like.

In one exemplary embodiment, the present invention provides a container configured to selectively enclose multiple food products, including: a tray including a first side wall, a second side wall, a front wall, a back wall, a bottom, and an internal wall disposed between the first side wall and the second side wall, wherein the first side wall, the second side wall, the front wall, the back wall, the bottom, and the internal wall disposed between the first side wall and the second side wall collectively define a first compartment configured to hold a first food product and a second compartment configured to hold a second food product; and a unified cover including a first side wall, a second side wall, a front wall, a back wall, and a top, wherein the first side wall, the second side wall, the front wall, the back wall, and the top are substantially coextensive with the tray.

In another exemplary embodiment, the present invention provides a method for providing a container configured to selectively enclose multiple food products, including: providing a tray including a first side wall, a second side wall, a front wall, a back wall, a bottom, and an internal wall disposed between the first side wall and the second side wall, wherein the first side wall, the second side wall, the front wall, the back wall, the bottom, and the internal wall disposed between the first side wall and the second side wall collectively define a first compartment configured to hold a first food product and a second compartment configured to hold a second food product; and providing a unified cover including a first side wall, a second side wall, a front wall, a back wall, and a top, wherein the first side wall, the second side wall, the front wall, the back wall, and the top are substantially coextensive with the tray.

BRIEF DESCRIPTION OF THE DRAWINGS

The present invention is illustrated and described herein with reference to the various drawings, in which like reference numbers are used to denote like container components/method steps, as appropriate, and in which.

DETAILED DESCRIPTION OF THE INVENTION

As described above, the present invention relates generally to a covered container for enclosing multiple food products. More specifically, the present invention relates to a folded paperboard container or the like having a unified cover for simultaneously enclosing a primary food product and a secondary food product, sauce/condiment container, or the like.

Figure 1:
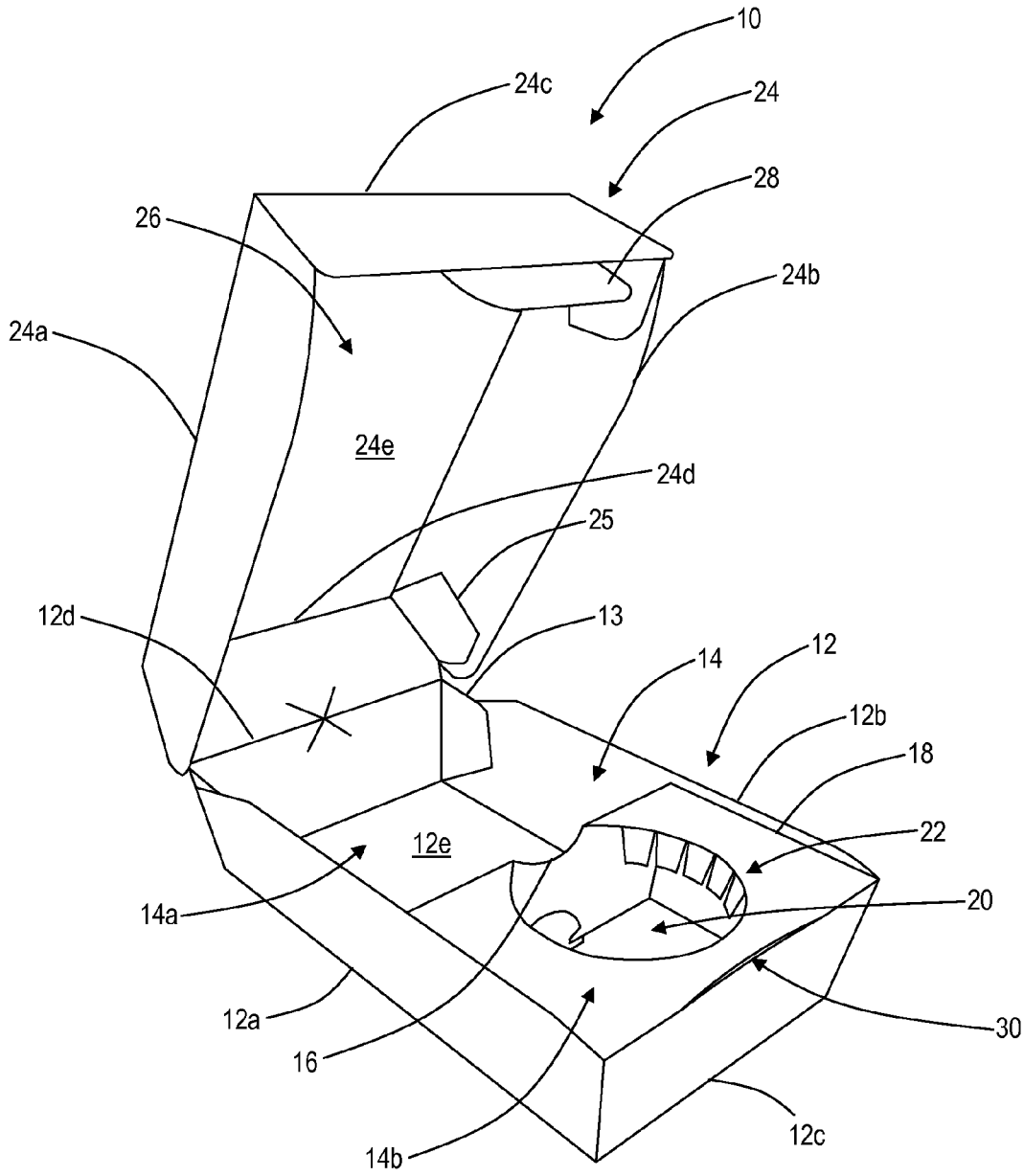
FIG. 1 is a perspective view of one exemplary embodiment of the container of the present invention in an assembled and partially open configuration, highlighting the unified cover and multiple food product compartments.

Referring to FIG. 1, in one exemplary embodiment, the container 10 of the present invention includes a tray 12 that is constructed from a first side wall 12*a*, a second side wall 12*b*, a front wall 12*c*, a back wall 12*d*, and a bottom 12*e*. Each of these components is made of paperboard or another suitable packaging material for food products. This packaging material may be substantially rigid, semi-rigid, or flexible, may be moisture resistant, may be insulative, may be heatable, etc. The first side wall 12*a*, the second side wall 12*b*, the front wall 12*c*, and the back wall 12*d* are each integrally formed with or substantially inseparable from the bottom 12*e* along multiple folds or joints. The first side wall 12*a*, the second side wall 12*b*, the front wall 12*c*, and the back wall 12*d* are connected to one another via multiple tabs 13 and corresponding slots (not illustrated) and/or an adhesive, or via folded expansion/contraction flexure joints, such that the first side wall 12*a*, the second side wall 12*b*, the front wall 12*c*, the back wall 12*d*, and the bottom 12*e* collectively form a prismatic compartment 14 suitable for containing and holding one or more food products or the like when assembled. This compartment 14 is divided into a first compartment 14*a* suitable for containing and holding a first food product or the like and a second compartment 14*b* suitable for containing and holding a second food product or the like via an internal wall 16 or other equivalent separation member spanning the compartment 14 between the first side wall 12*a* and the second side wall 12*b*. The internal wall 16 is integrally formed with or substantially inseparable from the front wall 12*c* via a second compartment top wall 18 along multiple folds or joints, for example, when assembled. Optionally, the internal wall 16 is attached to the bottom 12*e* of the tray 12 via a flap and tab 32 (FIG. 6) associated with the internal wall 16, a corresponding slot 34 (FIG. 6) associated with the bottom 12*e*, and/or an adhesive. In the exemplary embodiment illustrated, the second compartment top wall 18 includes a cut out 20 having multiple concentrically disposed tabs 22 or other equivalent retention structures. The cut out 20 and concentrically disposed tabs 22 are collectively configured to securely hold a substantially separable sauce/condiment container (not illustrated), such as a covered or uncovered plastic sauce/condiment container, or the like.

The container 10 also includes a unified cover 24 that selectively encloses both the first compartment 14*a* and the second compartment 14*b*. The unified cover 24 is constructed from a first side wall 24*a*, a second side wall 24*b*, a front wall 24*c*, a back wall 24*d*, and a top 24*e*. Each of these components is made of paperboard or another suitable packaging material for food products. This packaging material may be substantially rigid, semi-rigid, or flexible, may be moisture resistant, may be insulative, may be heatable, etc. The first side wall 24*a*, the second side wall 24*b*, the front wall 24*c*, and the back wall 24*d* are each integrally formed with or substantially inseparable from the top 24*e* along multiple folds or joints. The first side wall 24*a*, the second side wall 24*b*, the front wall 24*c*, and the back wall 24*d* are connected to one another via multiple tabs 25 and corresponding slots (not illustrated) and/or an adhesive, or via folded expansion/contraction flexure joints, such that the first side wall 24*a*, the second side wall 24*b*, the front wall 24*c*, the back wall 24*d*, and the top 24*e* collectively form a prismatic compartment 26 that is substantially coextensive with the compartment 14 of the tray 12. The front wall 24*c* of the unified cover 24 includes a tab 28 that is configured to selectively engage a corresponding slot 30 associated with the front wall 12*c* of the tray 12 when the unified cover 24 is closed, providing a sturdy closure.

Advantageously, this unified cover configuration, enclosing both the first compartment 14*a* and the second compartment 14*b* of the tray, provides the container 10 with enhanced structural strength and integrity, such that multiple containers 10 may be stacked and manipulated without damage.

Figure 2:
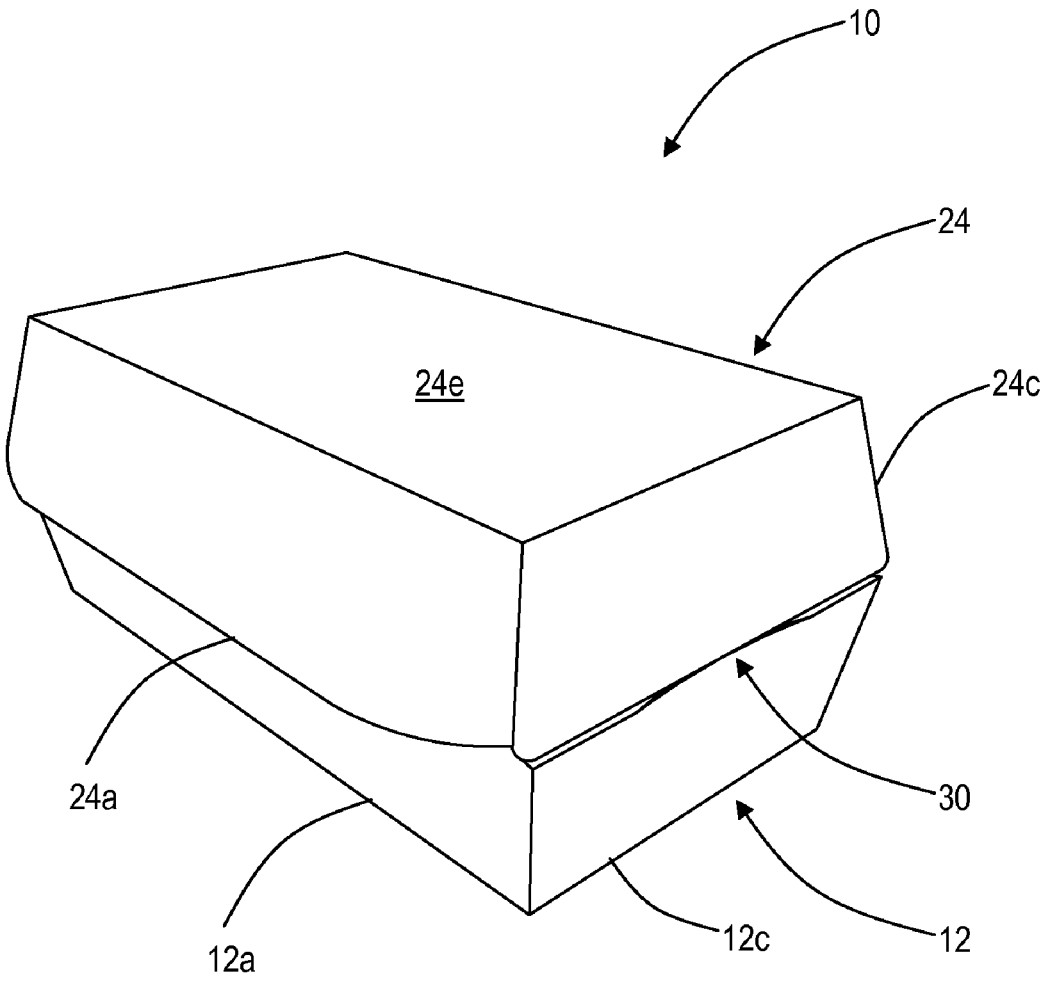
FIG. 2 is a perspective view of the container of FIG. 1 in an assembled and closed configuration, highlighting the unified cover.

FIG. 2 is a perspective view of the container 10 of FIG. 1 in an assembled and closed configuration, highlighting the unified cover 24.

Figure 3:
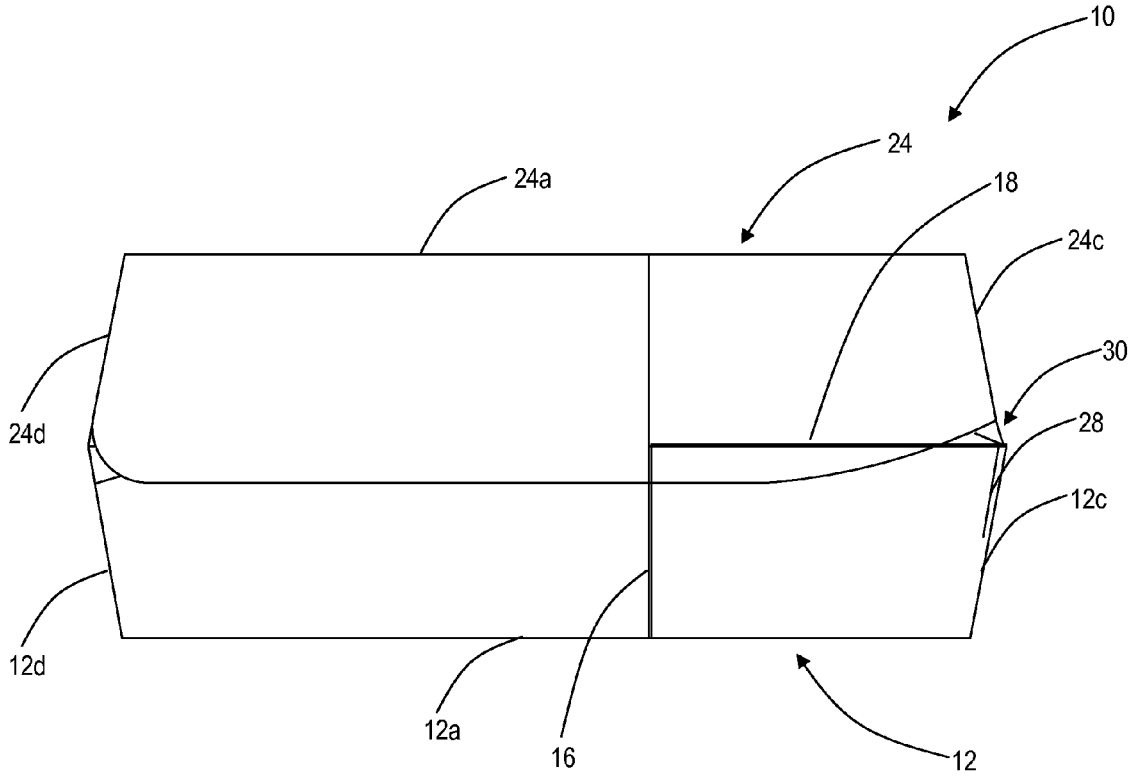
FIG. 3 is a planar side view of the container of FIG. 2.

FIG. 3 is a planar side view of the container 10 of FIG. 2.

Figure 4:
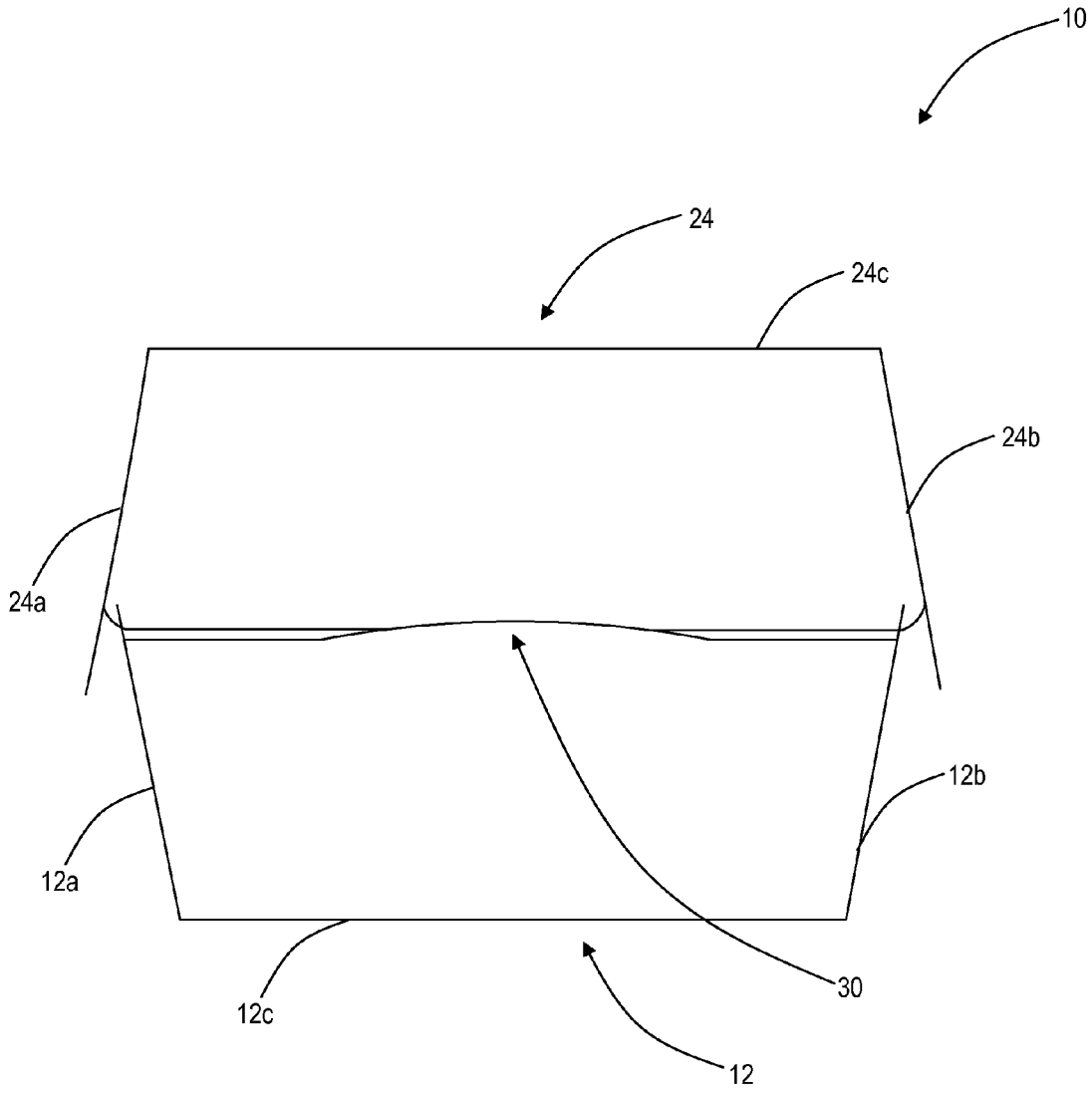
FIG. 4 is a planar end view of the container of FIGS. 2 and 3.

FIG. 4 is a planar end view of the container 10 of FIGS. 2 and 3.

Figure 5:
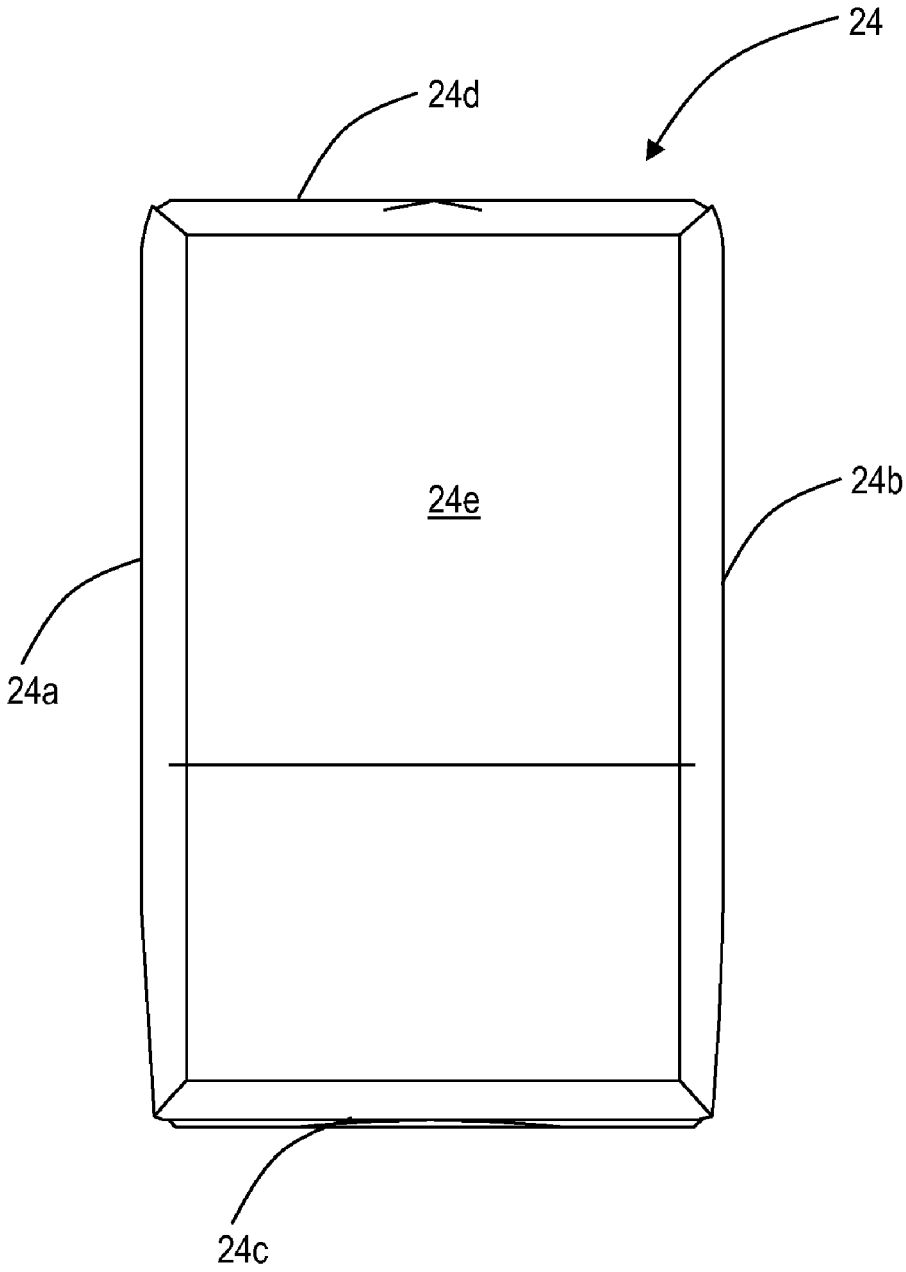
FIG. 5 is a planar top view of the container of FIGS. 2-4.

FIG. 5 is a planar top view of the container 10 of FIGS. 2-4.

Figure 6:
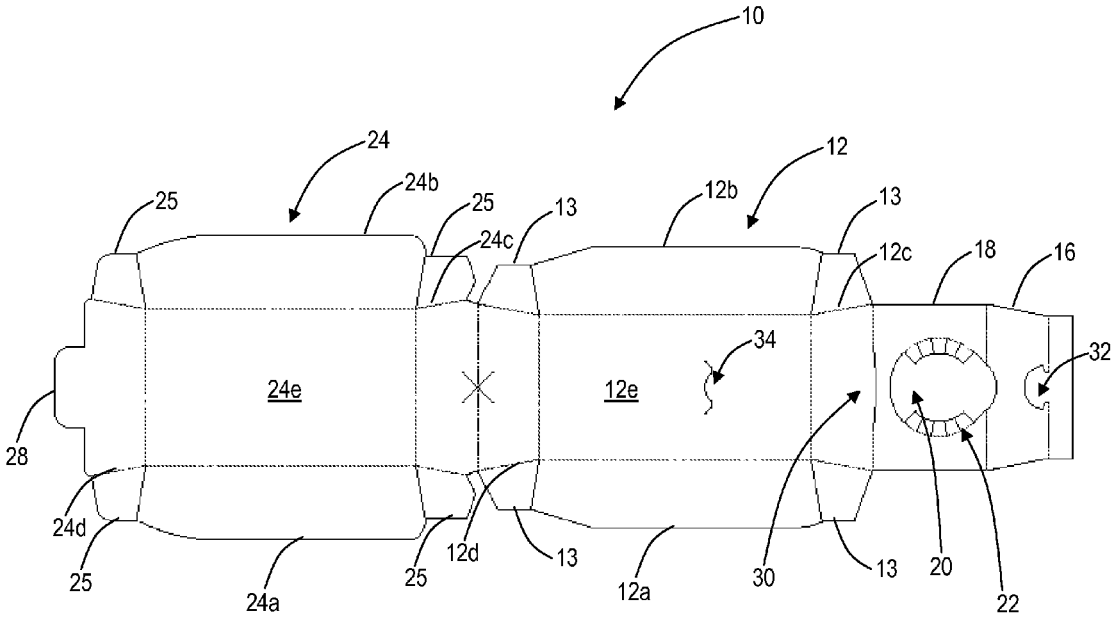
FIG. 6 is a planar top view of the container of FIGS. 1-5 in an unassembled configuration, highlighting the components of the unified cover and multiple food product compartments.

FIG. 6 is a planar top view of the container 10 of FIGS. 1-5 in an unassembled configuration, highlighting the components of the unified cover 24 and multiple food product compartments 14*a* and 14*b* (FIG. 1).

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A container configured to selectively enclose multiple food products, comprising:

a tray comprising a first side wall, a second side wall, a front wall, a back wall, a bottom, and an internal wall disposed between the first side wall and the second side wall, wherein the first side wall, the second side wall, the front wall, the back wall, the bottom, and the internal wall disposed between the first side wall and the second side wall collectively define a first compartment configured to hold a first food product and a second compartment configured to hold a second food product, wherein the internal wall is coupled to the front wall of the tray via a second compartment top wall; and a unified cover comprising a first side wall, a second side wall, a front wall, a back wall, and a top, wherein the first side wall, the second side wall, the front wall, the back wall, and the top of the unified cover are substantially coextensive with the tray, wherein the front wall of the unified cover comprises a tab that is configured to selectively engage a corresponding slot formed in the second compartment top wall of the tray such that a bottom edge of the front wall of the unified cover rests on a front edge of the second compartment top wall of the tray when the unified cover is closed.

2. The container of claim 1, wherein the first side wall, the second side wall, the front wall, and the back wall of the tray are one or more of integrally formed with and substantially inseparable from the bottom along a plurality of folds or joints.

3. The container of claim 1, wherein the first side wall, the second side wall, the front wall, and the back wall of the tray are connected to one another via one or more of a plurality of tabs and corresponding slots, an adhesive, and a plurality of folded expansion/contraction flexure joints.

4. The container of claim 1, wherein the internal wall is selectively attached to the bottom via one or more of a flap and tab associated with the internal wall, a corresponding slot associated with the bottom of the tray, and an adhesive.

5. The container of claim 1, wherein the second compartment top wall defines a cut out comprising multiple concentrically disposed retention structures.

6. The container of claim 1, wherein the first side wall, the second side wall, the front wall, and the back wall of the unified cover are one or more of integrally formed with and substantially inseparable from the top along a plurality of folds or joints.

7. The container of claim 1, wherein the first side wall, the second side wall, the front wall, and the back wall of the unified cover are connected to one another via one or more of a plurality of tabs and corresponding slots, an adhesive, and a plurality of folded expansion/contraction flexure joints.

8. A method for providing a container configured to selectively enclose multiple food products, comprising:

providing a tray comprising a first side wall, a second side wall, a front wall, a back wall, a bottom, and an internal wall disposed between the first side wall and the second side wall, wherein the first side wall, the second side wall, the front wall, the back wall, the bottom, and the internal wall disposed between the first side wall and the second side wall collectively define a first compartment configured to hold a first food product and a second compartment configured to hold a second food product, wherein the internal wall is coupled to the front wall of the tray via a second compartment top wall; and providing a unified cover comprising a first side wall, a second side wall, a front wall, a back wall, and a top, wherein the first side wall, the second side wall, the front wall, the back wall, and the top of the unified cover are substantially coextensive with the tray, wherein the front wall of the unified cover comprises a tab that is configured to selectively engage a corresponding slot formed in the second compartment top wall of the tray such that a bottom edge of the front wall of the unified cover rests on a front edge of the second compartment top wall of the tray when the unified cover is closed.

9. The method of claim 8, wherein the first side wall, the second side wall, the front wall, and the back wall of the tray are one or more of integrally formed with and substantially inseparable from the bottom along a plurality of folds or joints.

10. The method of claim 8, wherein the first side wall, the second side wall, the front wall, and the back wall of the tray are connected to one another via one or more of a plurality of tabs and corresponding slots, an adhesive, and a plurality of folded expansion/contraction flexure joints.

11. The method of claim 8, wherein the internal wall is selectively attached to the bottom via one or more of a flap and tab associated with the internal wall, a corresponding slot associated with the bottom of the tray, and an adhesive.

12. The method of claim 8, wherein the second compartment top wall defines a cut out comprising multiple concentrically disposed retention structures.

13. The method of claim 8, wherein the first side wall, the second side wall, the front wall, and the back wall of the unified cover are one or more of integrally formed with and substantially inseparable from the top along a plurality of folds or joints.

14. The method of claim 8, wherein the first side wall, the second side wall, the front wall, and the back wall of the unified cover are connected to one another via one or more of a plurality of tabs and corresponding slots, an adhesive, and a plurality of folded expansion/contraction flexure joints.

* * * * *